United States Patent [19]

Nicholson, Jr.

[11] 4,202,512

[45] May 13, 1980

[54] LEVEL LAYER WINDING METHOD AND APPARATUS

[76] Inventor: Thomas F. Nicholson, Jr., 3440 Belair Rd., Baltimore, Md. 21213

[21] Appl. No.: 814,655

[22] Filed: Jul. 11, 1977

Related U.S. Application Data

[63] Continuation of Ser. No. 232,363, Mar. 7, 1972, abandoned.

[51] Int. Cl.[2] ..... B65H 57/00; B65H 57/28

[52] U.S. Cl. ..... 242/157.1; 242/25 R

[58] Field of Search ..... 242/157.1, 158 R, 25 R, 242/7.14

[56] References Cited

U.S. PATENT DOCUMENTS

| | | | |
|---|---|---|---|
| 537,730 | 4/1895 | Stevens | 242/157.1 UX |
| 1,573,933 | 2/1926 | Guest | 242/7.14 X |
| 1,587,998 | 6/1926 | Adams | 242/158 R |
| 2,243,624 | 5/1941 | Gazet | 242/157.1 |
| 2,599,423 | 6/1952 | Ziegler | 242/158 R X |
| 2,740,594 | 4/1956 | Stevens | 242/158 R |
| 2,906,468 | 9/1959 | Wellcome | 242/25 R |
| 3,598,338 | 8/1971 | Brushenko | 242/158 R |
| 3,671,016 | 6/1972 | Gladysz | 242/158 R X |

FOREIGN PATENT DOCUMENTS

| | | | |
|---|---|---|---|
| 1281030 | 10/1968 | Fed. Rep. of Germany | 242/25 R |
| 481594 | 9/1916 | France | 242/158 R |
| 818247 | 6/1937 | France | 242/157.1 |
| 1256653 | 2/1961 | France | 242/157.1 |
| 483356 | 4/1938 | United Kingdom | 242/157.1 |
| 980903 | 1/1965 | United Kingdom | 242/25 R |

*Primary Examiner*—Stanley N. Gilreath
*Attorney, Agent, or Firm*—Louis A. Scholz

[57] ABSTRACT

A material strand automatic winding mechanism, and more particularly to the strand feeding and distributing device, and in particular a level layer guide device. This invention relates to a guide for uniformly winding a strand in a level layer on a spool, bobbin, and the like, by means of a follower wheel having a convex radius periphery greater than that of the strand to be wound, but not twice as great with frictional lateral resistance means.

8 Claims, 18 Drawing Figures

LEVEL LAYER WINDING METHOD AND APPARATUS

CROSS-REFERENCE TO RELATED APPLICATIONS

This is a continuation of application Ser. No. 232,363 filed Mar. 7, 1972, now abandoned.

BACKGROUND OF THE INVENTION

This equipment solves a problem worked on by a number of prior inventors, with some degree of success as exibited by their inventions. Some of these inventions are cited here to show the state-of-the-art: namely U.S. Pat. Nos. 2,740,594; 2,599,423; 1,587,998 and 11,342, which show the various methods that have been used by inventors to effect level layer winding; from the lever actuated differential clutch feed arrangement, shown in U.S. Pat. No. 11,342, through the triple element guide wheel of U.S. Pat. No. 1,587,998 to the counterthreaded high-centered, bobbin-reversing guide cylinder of U.S. Pat. No. 2,740,594; but no one of these Patents teaches an art, method, or apparatus which will result in an automatic spooled level layer winding operation wherein the successive layers are in tension tightly wound, in a level layer, from spool end to spool opposite end, regardless of original kink, twist, or internal stress, and diameter of wire.

SUMMARY OF THE INVENTION

An object of the invention is to provide an improved material feeding and distributing device for use with material winding machines.

In accordance with the features of the invention, there is provided in one embodiment thereof, a guiding member comprising a flat disk tapered at its periphery or a post or a disk having an edge thickness substantially larger but not more than twice as large as the diameter of the strand to be fed, positioned preferably at a distance from the side of the adjacent strand, not greater than the diameter of the strand being fed. The thickness of the member at its delivery point is substantially larger and with a rounded periphery of at least the same diameter as that of the strand. The disk may be rotatably mounted upon a distributor arm with its delivery point closely adjacent to the winding surface tangency point of the spool, the forward or movable end of the distributor arm being pivotally secured to a member, reciprocating in a path substantially parallel to the longitudinal axis of the spool during the winding of each layer thereon. The arm is fixed to a base and provides movement in a horizontal plane which is limited only by two, spaced, stationary stop members, providing movement, with controlled or limited freedom, substantially parallel to the winding arbor during the reciprocations of the forward end of the arm. The disk is positioned to provide friction induced force against the newly arriving portion of the strand being wound parallel to the existing level layer wound surface and against the immediately adjacent just wound ring portion of the strand.

It is believed that the invention will be more clearly understood from the following description taken in connection with the accompanying drawings illustrating the invention. . .

FIG. 1 is an isometric view of the invention apparatus using the improved method in a simple form.

FIGS. 2*a*–2*e* is a series of sub-figures in partial cross-section showing the action of the guide apparatus as it forces the lay of each successive element of the strand into level layer winding.

FIG. 3 is an isometric view of the invention using a modified form of guide member.

FIGS. 4*a*–4*e* is a series of sub-figures in partial cross-section showing the successive steps of operation of the device of FIG. 3.

FIG. 5 is an isometric view of the invention using a second modified form of guide member.

FIGS. 6*a*–6*e* is a series of figures in partial cross-section showing the successive steps of operation of the device of FIG. 5.

This invention describes a device for controlling or guiding wire or like filamentary material while winding onto spools. For convenience, the invention will be described as employed in controlling the position of successive rings in a helical spiral of wire, during the winding of wire on spools, but it is to be understood that the invention is equally applicable to the control of threads, strands, cable assemblies, coated wires, tubes, and other like filamentary materials during winding onto spools or reels or a cylinder with removable spool ends.

DETAILED DESCRIPTION

Many types of wire and other filamentary or strand materials are stored and handled on spools, for example in the case of continuous welding wire which is sold on and used from spools. It is of decided advantage to wind the maximum length of wire on the spool. This can be accomplished by maintaining a constant tension on the wire while winding, and additionally forcing each successive ring of the helical level layer pattern the wire makes on the spool tight against the preceding ring. This will produce a spool with uniform successive layers of substantially concentric rings of wire tightly wound. This winding process has been called by many common names such as: thread level winding, thread lay winding, and precision layer-level winding. To wind high tensile strength wire onto a spool in this manner requires a specially skilled spooling operator using a hand-held guide tool to control the position of the wire on the spool and to maintain the optimum condition of continued directed tension by forcing each successive ring of wire tight against the last. This manual method of guiding of the wire requires particular attention during the setting of the first layer of wire placed on a spool.

Figure 1:
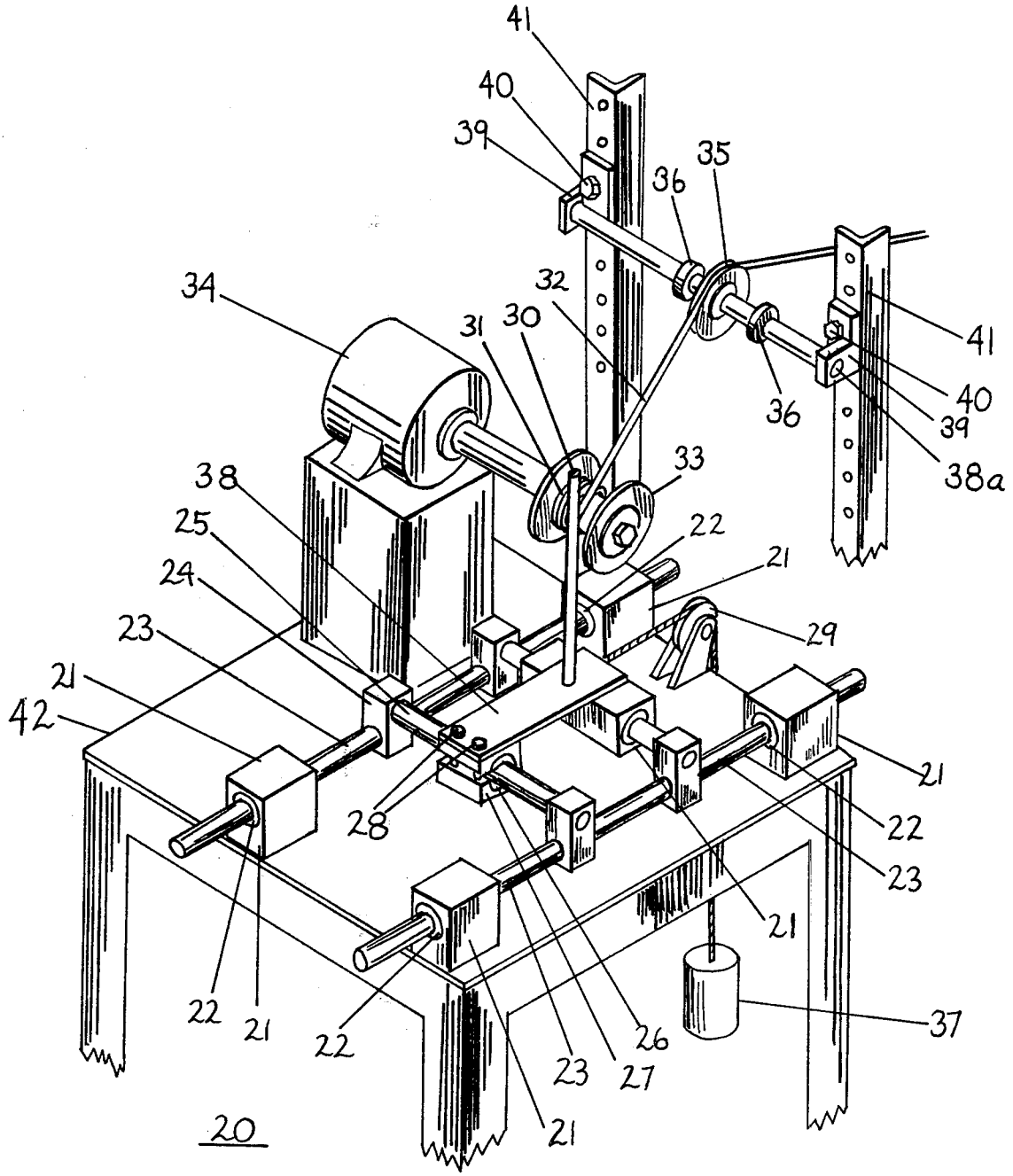
Figure 2A:
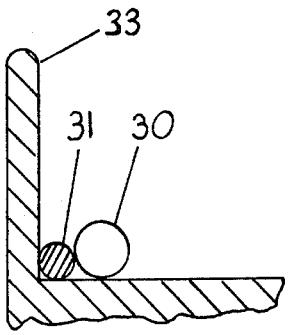
Figure 2B:
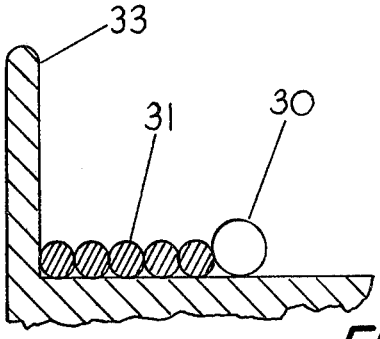
Figure 2C:
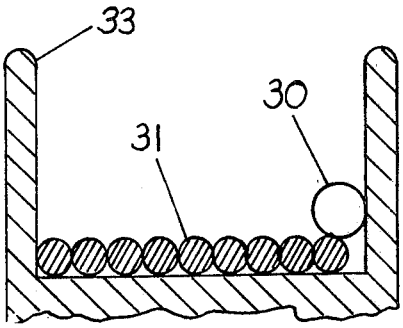
Figure 2D:
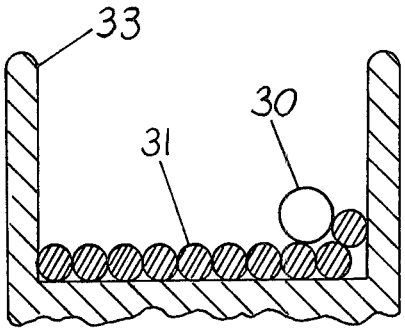
Figure 2E:
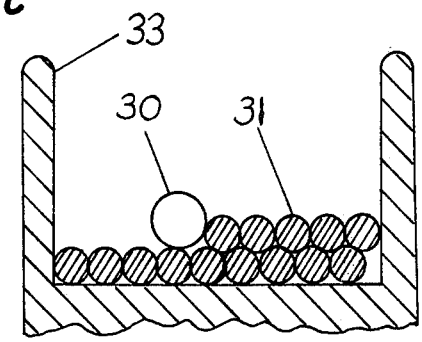

Referring to FIG. 1, the wire level winder is composed basically of a coiling means, most usually a motor 34 that rotates a spindle mounted spool 33 and the pilot guide member 30 which is actuated in such a manner as to guide the lay of the wire 32 being supplied into a level lay 31 on the spool in one or more layers. In this particular level lay winder 20 there is a table or base 42 on which the various components are mounted. There are linear bearing housings 21 with their bearings 22 which support the shafts 23, all in duplicate which provide a crossing motion perpendicular to the axis of shaft 33 called herein the "x" axis for the pilot guide 30 permitting the same to move along mutually perpendicular x and y axes. This crossing motion is kept tensioned against the spool by weight 37 through the usual means of a cable running over pulley 29. Pilot guide means 30 is mounted on a base or pilot base 38 and this, in turn, is supported on linear bearings 27 or friction connectors that have an adjustable friction means 26 that are adjustable by means of adjusting bolts 28 to provide an adjustable amount of friction for the Y-axis motion which is perpendicular to the X-axis motion. The Y-axis motion is a resistive motion, resisting the push of the newly-laid wire or strand 32. There are cross-link connectors 24 that are supported by shafts 23 and in turn by shafts 25, on which the base 38 can move in the Y-motion and this base 38 has a clamp 27 which adjusts the normal force against the shaft 25 of the friction element 26. There is a slidable pulley 35 that acts as a wire guide to keep the wire that is coming from the supply spool (not shown) traveling onto the winding bobbin at the same angular relationship to the bobbin, and to adjust the point of rotation at which the wire contacts the spool. This done in a known means, not claimed. The pulley 35 is limited in its action by collars 36 and supported on shaft 38*a* which is held adjustably on brackets 39 which in turn are on vertical brackets or upright supports 41 by means of bolt 40.

Referring now particularly to subfigures *2a, 2b, 2c, 2d,* and *2e,* which show a partial cross-section looking in the direction from which the wire is being supplied, as it is wound on the spool or bobbin. It can be seen that since wire 31 is being laid against the core of the spool and one flange of the spool and the pilot guide 30 is resisting the action of that lay along the axis of the spool rotation, it is only the wedging action of the newly arriving additional layers of wire that keep shoving member 30 horizontally until the last wire lay approaches the opposite flange at which time the parallelogram of forces involved in the tangential contact of the newly-laid wire and the pilot guide member are such that it forces the pilot guide 30 tangentially, away from the axis of the bobbin and against the flange of the spool as in FIG. *2c;* until the next newly-laid wire length, as in FIG. *2d,* then wedges the pilot guide in a direction backwards from that which the pilot guide was traveling, the pilot guide continues moving in this second direction opposite to which it has previously been traveling, keeping a tight level lay against the core and each flange of the spool.

Figure 3:
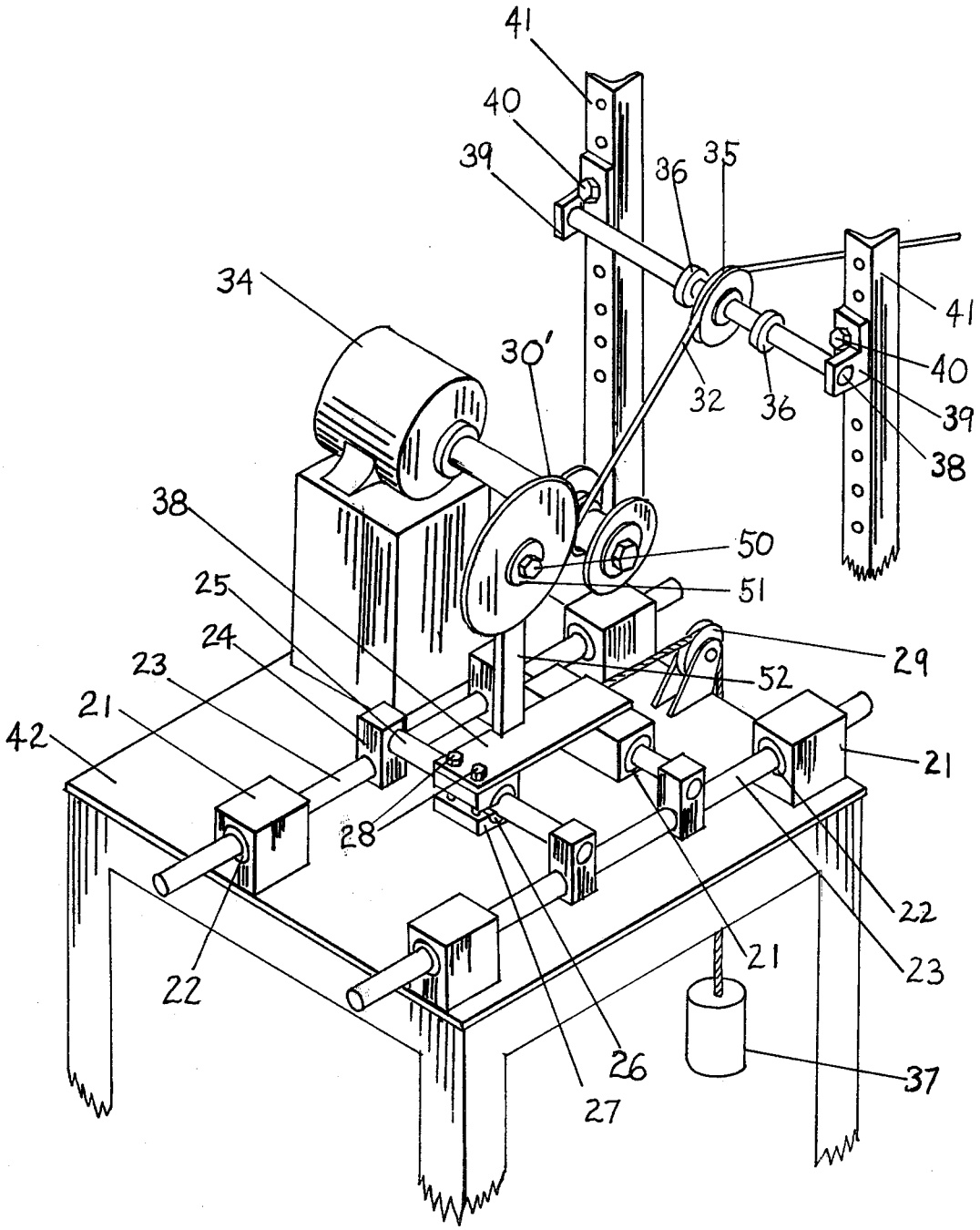
Figure 4A:
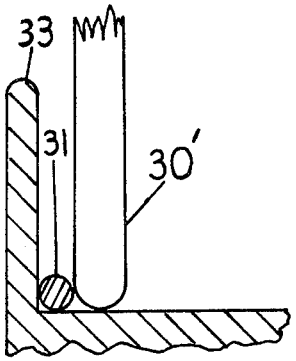
Figure 4B:
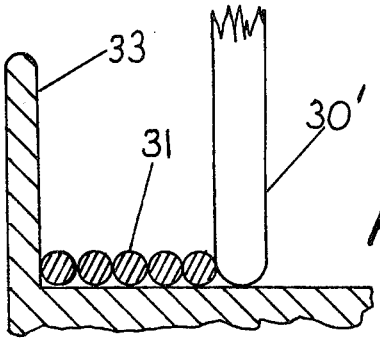
Figure 4C:
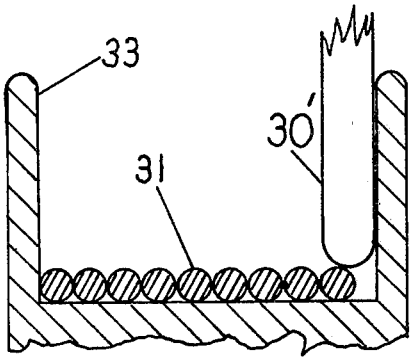
Figure 4D:
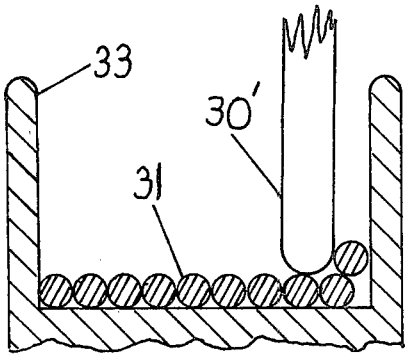
Figure 4E:
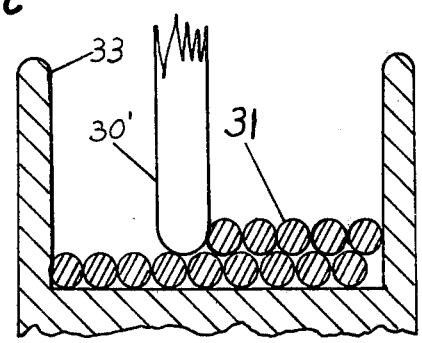

Instead of the highly-frictioned wearing device, it can be seen in modification of FIG. 3 that the single rod may be replaced by a disk 30' with a radius edge, the radius edge in this case being such that it is slightly greater than the radius of the wire involved similarly as was the pilot guide rod 30. This is a pilot guide disk with a radius edge and this operates, as can be seen in sub figures *4a, 4b,* etc. in a manner substantially similar to that of the previous pilot guide rod explanation, except that in this case the disk tends to rotate and out down any friction that would be involved, preventing damage to the surface of the wire being wound, as more particularly shown in FIG. 3.

Figure 5:
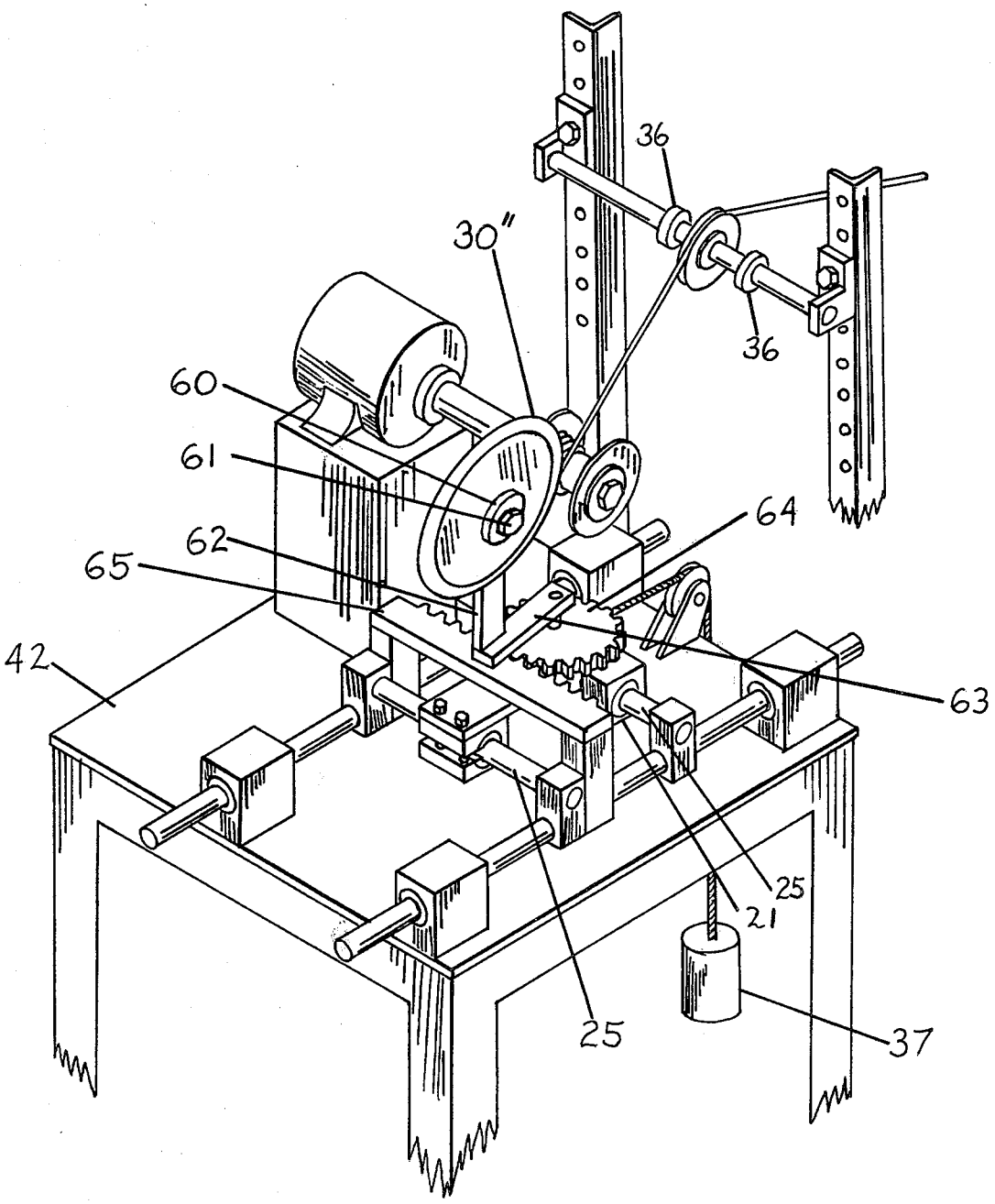
Figure 6A:
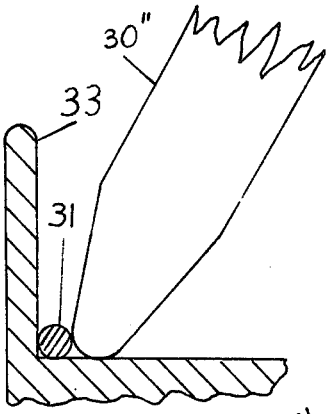
Figure 6B:
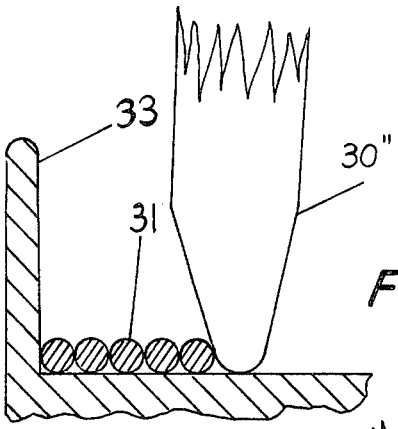
Figure 6C:
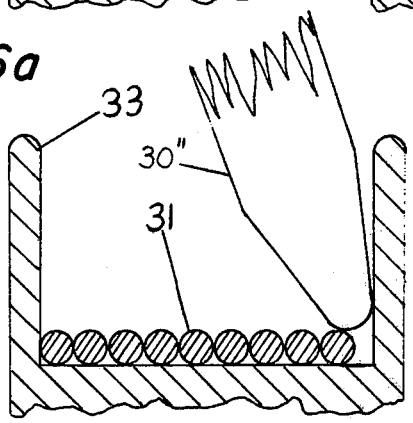
Figure 6D:
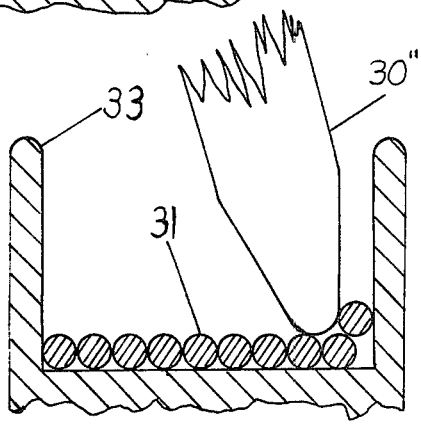
Figure 6E:
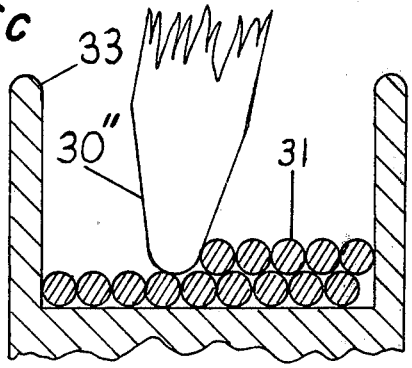

In FIG. 5, another modification is shown wherein the disk 30" for purposes of rigidity is tapered and because it is tapered, and in order to allow it to follow into the corners formed by the substantially parallel flanged spool ends and the core cylinder, it is necessary to rotate this disk angularly with respect to the core axis an amount equal to or slightly greater than that of the angles subtended by the two sloping faces of the tapered periphery. This is accomplished by gear 64 pivotally slidably supported on housing 21 and rack 65 rigidly supported on cross link connector 24 which does not allow the rack to move in relation to housing 21 motion so that as the disk or wheel 30" is pushed from side to side, the resultant forces against the rack 65 by the wheel rigidly attached to the pinion gear 64 are such that it rotates or pivots the disk 30" in the angular position shown in detail in subfigures *6a, 6b, 6c, 6d,* and *6e.*

The modification of FIG. 5 contemplates substitution of a thicker wheel or disk having a triangular-shaped edge, the apex of which is formed to a radius larger than that of the wire, and mounted in such a way as to rotate during its traverse with its bearing 21 along shafts 25 in a plane parallel to the axis of the spool. The disk 30" is supported by an "L" shaped base 62, 63 which has its base rigidly attached over the center of rotation of gear 64, and which has the top of said "L" penetrated by bolt axle 61 which has a bearing washer 60 to assist in holding disk 30" firmly, freely rotatable about bolt 61 axis. The disk is moveable through an arc greater than the included angle of its triangular edge, and has all the properties of movement and resistance to movement of the aforementioned thin disk and has been found to be the more universally-adaptable guide. The arcuate pivoting is such that the sides of the disk do not touch flanges on either side of the spool during the traverse, and a portion of the radius formed at the edge is all that contacts the spool or the wire while winding.

I claim:

1. A method for controlling wire or like filamentary materials while winding in successive level layers on to rotatively driven spools or reels, comprising the steps of;

urging a rigid convex filament guide means, having a crossectional radius slightly larger than that of the radius of the material being wound, perpendicularly toward the axis of rotation of said spool engaging the guide means with a wound coil of wire on the side of the wire opposite a previously wound coil of wire, moving said guide means back and forth in a path parallel to the axis and substantially between the ends of said driven spool, responsive to engagement with the newly wound wire, resisting said back and forth movement of said guide means in response to wire winding in tight level layer alignment, and, adjusting the amount of resistance to said back and forth movement of said guide means in cooperation with said perpendicularly urging step to hold each successive wire being wound against a previously wound wire of an underlying layer or against the initially unwound core and laterally against adjacent wound coils in the layer being wound so that said guide means will exert pressure against the wire being wound on said spool in directions longitudinally of and perpendicularly to the axis of rotation of the spool.

2. a method for controlling wire or like filamentary materials while winding in successive level layers on to rotatively driven spools or reels, comprising the steps of;

urging a rigid convex filament guide means, having a crossectional radius slightly larger than that of the radius of the material being wound, perpendicularly toward the axis of rotation of said spool, engaging the guide means with a wound coil of wire on the side of the wire opposite a previously wound coil of wire, moving the guide means back and forth in a path parallel to the axis and substantially between the ends of said driven spool, responsive to engagement with the newly wound wire, applying force laterally against the side of the convolutions of the wire being wound by resisting said back and forth movement of said guide means in response to the push of the newly laid wire, and in response to wire winding in tight level layer alignment, and, adjusting the amount of resistance to said back and forth movement of said guide means in cooperation with said perpendicularly urging step to hold each successive wire being wound against a previously wound wire of an underlying layer or against the initially unwound core, and laterally against adjacent wound coils in the layer being wound so that said guide means will exert pressure against the wire being wound on said spool in directions longitudinally of and perpendicularly to the axis of rotation of the spool.

3. An apparatus for controlling wire or like filamentary materials while winding in successive level layers, on to rotatively driven spools on reels, said apparatus comprising;

rigid convex guide means having a crossectional radius slightly larger than that of the radius of the material being wound, means for urging said guide means perpendicularly toward the axis of rotation of said spool and into engagement with a wound coil of wire on the side of the wire opposite a previously wound coil, supporting means for said guide means, said supporting means being mounted for lateral movement back and forth in a path parallel to the axis and substantially between the ends of said driven spool thereby to reciprocate said guide means, adjustable friction means for said lateral movement supporting means thereby to provide resistance to lateral movement of said guide means and causing said laterally moving guide means in cooperation with said perpendicularly-acting urging means to hold each successive wire being wound against a previously wound wire of an underlying layer or against the initial unwound core and laterally against an adjacent wire winding in the layer being wound.

4. A device as in claim 3 wherein said guide means is a rigid cylindrical guide.

5. A device as in claim 3 wherein said guide means is a rotating disk.

6. A device as in claim 3 wherein said guide means is a rotating disk having tapered faces rigidly supporting said rigid convex guide means.

7. A device as in claim 3 wherein said urging means is a gravity operated weight.

8. A device as in claim 3 wherein said support means is a truck riding on a pair of parallel rigid tracks.

* * * * *